US007285055B2

(12) United States Patent
Radle

(10) Patent No.: US 7,285,055 B2
(45) Date of Patent: Oct. 23, 2007

(54) GOLF CLUB SWING TRAINING DEVICE

(76) Inventor: Rick E. Radle, 3829 Black Creek Dr., Hudsonville, MI (US) 49426

( * ) Notice: Subject to any disclaimer, the term of this patent is extended or adjusted under 35 U.S.C. 154(b) by 137 days.

(21) Appl. No.: 11/208,075

(22) Filed: Aug. 19, 2005

(65) Prior Publication Data

US 2006/0040759 A1 Feb. 23, 2006

Related U.S. Application Data

(60) Provisional application No. 60/602,843, filed on Aug. 19, 2004.

(51) Int. Cl.
*A63B 69/36* (2006.01)

(52) U.S. Cl. ..... 473/228; 473/226

(58) Field of Classification Search ..... 473/219, 473/226, 228, 422, 437, 463, 457; D21/791
See application file for complete search history.

(56) References Cited

U.S. PATENT DOCUMENTS 3,758,117 A * 9/1973 Harrison ..... 473/231
4,576,378 A 3/1986 Backus
5,002,275 A 3/1991 Beutler et al.
5,165,683 A 11/1992 Beutler et al.
5,184,825 A 2/1993 Ruth
5,207,625 A 5/1993 White
5,310,188 A 5/1994 Hernberg
5,335,918 A 8/1994 Rupnik et al.
5,415,406 A 5/1995 Reichenbach et al.
6,881,156 B1 * 4/2005 Phillips ..... 473/228
7,118,490 B2 * 10/2006 Namba ..... 473/228

* cited by examiner

*Primary Examiner*—Nini F. Legesse
(74) *Attorney, Agent, or Firm*—Miller, Canfield, Paddock and Stone; Robert K. Roth

(57) ABSTRACT

A golf club swing training device adapted for use with a golf club having a shaft and a head comprises a wing adapted to provide resistance to motion as the club is swung, and a bracket adapted to connect the golf club with the wing. The wing is pivotably attached to the bracket and restricted to a travel range of 60-120 degrees with respect to the bracket.

10 Claims, 6 Drawing Sheets

GOLF CLUB SWING TRAINING DEVICE

RELATED APPLICATION

This application claims priority benefit of U.S. provisional patent application No. 60/602,843 filed on Aug. 19, 2004.

FIELD OF THE INVENTION

This invention relates to a device for training a person to swing a golf club, and more particularly to a device which attaches to the shaft of a club to guide a person's swing.

BACKGROUND OF THE INVENTION

One of the most common errant swings a player of golf makes is a slice. Slicing usually occurs when a player fails to square a face of a golf club at impact with a golf ball because the player does not pronate his trailing wrist before impact with the golf ball. A golf club swing training device can be helpful to correct errors in a player's swing. Golf club swing training devices for players of golf are known. They include, for example, those disclosed in U.S. Pat. No. 5,310,188 to Hernberg. Hernberg discloses an attachment having four stationary fins mounted on a golf club which create wind resistance as a player swings the club. However, the resistance generated may or may not be in an appropriate direction for the player as he swings the golf club. U.S. Pat. No. 5,335,918 to Rupnik et al discloses a training airfoil attachment for a golf club having a curved cross-section, attached to the shaft of the golf club to promote the correct swing due to the airflow over the airfoil imparting lift on the convex side of the airfoil. However, this airfoil is fixed with respect to the golf club and limited in its ability to aid in a player's swing.

U.S. Pat. No. 5,184,825 to Ruth discloses a sail which when attached to the golf club, raises the wind resistance of the golf club relative to amount of wind resistance exhibited by the club during swinging movements made without the sail. However, this increased resistance is obtained without creating any torque forces on the club. U.S. Pat. No. 5,207,625 to White discloses a swing motion device for providing exercise and training having a plurality of collapsible vanes mounted on a shaft that an athlete may grip and swing through the air. The vanes provide air resistance against which the athlete's muscles must work. Each vane may comprise a foldable wire framework covered with a bag-like fabric sheath. When the vanes are collapsed, the device assumes a compact shape for transport and storage.

U.S. Pat. No. 5,415,406 to Reichenbach et al discloses a blade extending from both sides of a golf club and attached to a golf club in such a manner that it will stay in the mounted position on the golf club shaft or will rotate depending on how the golf club is swung. However, the device does not kinetically manipulate a player's hands and wrists during the swing to promote the proper golf swing. Furthermore, it does not use wind resistance generated by the act of swinging the club to create the torque in the appropriate direction at the proper time during the swing, and nothing limits the range of motion of movement during a swing.

U.S. Pat. No. 5,165,683 to Beutler et al discloses an apparatus having a pair of half blades which do not attach to an existing club. Instead, the apparatus is a stand alone device where the blades can swivel with respect to a shaft. This is designed to provide constant resistive force during a swing by having the half blades remain perpendicular to a swing plane throughout a downswing. U.S. Pat. No. 5,002,275 to Beutler et al discloses a device similar to U.S. Pat. No. 5,165,683. It too is designed so as to remain perpendicular to the swing plane throughout a players swing or stroke motion, causing a constant resistance for exercising muscles. It does not swivel to create the torque in the appropriate direction at the proper time during the swing.

U.S. Pat. No. 4,576,378 to Backus discloses an airfoil to place progressively increasing torque on the golf club during a downswing. However, it attaches to the shaft in a fixed position. While this does aid the player in providing the torque necessary to square golf club at impact, it does not help with other portions of the swing, such as appropriate inertial resistance at the beginning of a backswing and torque during the backswing, as well as the follow through, all of which are important elements of a golf swing. It would be highly desirable to have an improved golf swing training device which assists a player with his swing over a wide range of motion.

SUMMARY OF THE INVENTION

In accordance with a first aspect, a golf club swing training device adapted for use with a golf club having a shaft and a head comprises a wing adapted to provide resistance to motion as the club is swung, and a bracket adapted to connect the golf club with the wing. The wing is pivotably attached to the bracket and restricted to a travel range of 60-120 degrees with respect to the bracket.

From the foregoing disclosure and the following more detailed description of various preferred embodiments it will be apparent to those skilled in the art that the present invention provides a significant advance in the technology and art of golf club swing training devices. Particularly significant in this regard is the potential the invention affords for providing a high quality golf swing training device. Additional features and advantages of various preferred embodiments will be better understood in view of the detailed description provided below.

Figure 1:
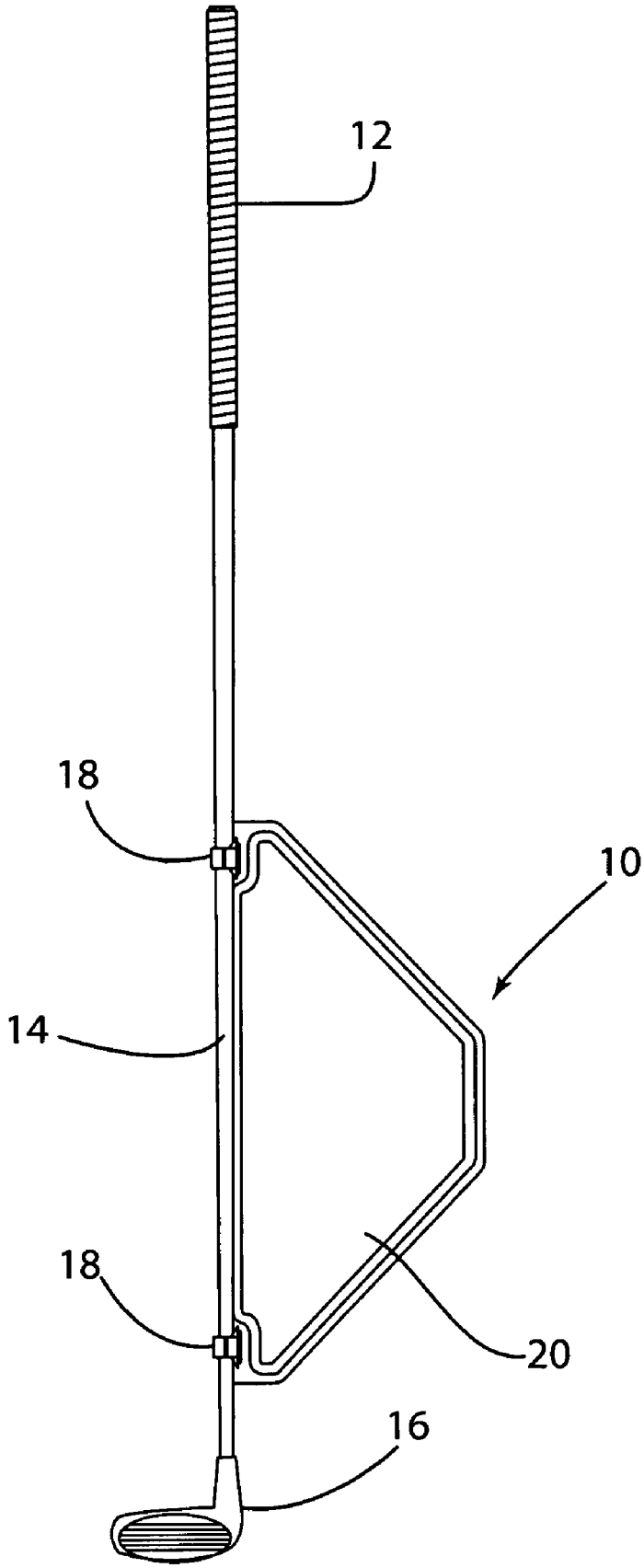
FIG. 1 is a side elevation view of a golf club swing training device in accordance with a preferred embodiment.

It should be understood that the appended drawings are not necessarily to scale, presenting a somewhat simplified representation of various preferred features illustrative of the basic principles of the invention. The specific design features of the golf club wing training device as disclosed here will be determined in part by the particular intended application and use environment. Certain features of the illustrated embodiments have been enlarged or distorted relative to others for visualization and clear understanding. In particular, thin features may be thickened, for example, for clarity of illustration. All references to direction and position, unless otherwise indicated, refer to the orientation illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the golf club swing training device disclosed here. The following detailed discussion of various alternative and preferred features and embodiments will illustrate the general principles of the invention with reference to a golf swing training device suitable for use on golf clubs. Other embodiments suitable for other applications will be apparent to those skilled in the art given the benefit of this disclosure.

Turning now to the drawings, FIG. 1 shows a view of a golf club swing training device 10 mounted on a golf club 12 as would be the case for a right handed golfer. The training device is shown to have brackets 18 removably mounted on a shaft 14 of the golf club generally above the head 16 of the club 12. The brackets fasten to the shaft securely and remain fixed about the shaft while the club is swung. Optionally, the brackets could be permanently attached to the golf club, or formed as a unitary extension of the club. A wing 20 is mounted on the bracket 18 and comprises a thin, flat, lightweight injection molded member which provides additional drag or resistance as a player swings the golf club in a manner described in greater detail below.

Figure 2:
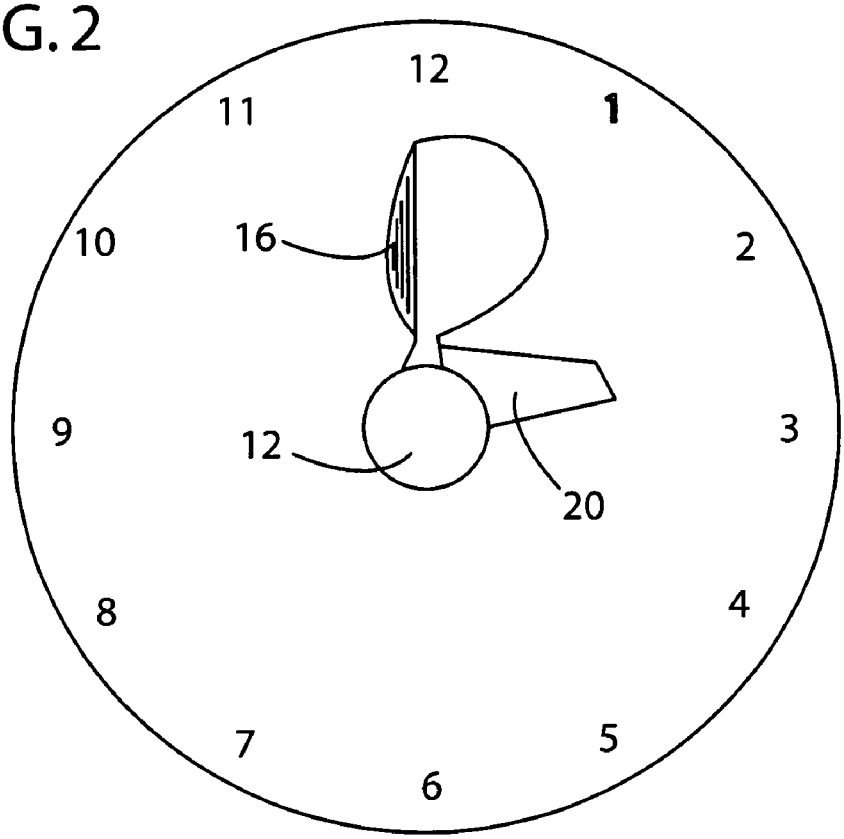
FIG. 2 is a schematic view of the golf club swing training device of FIG. 1 shown from an end of the shaft, shown in a "3 O'clock" position.
Figure 3:
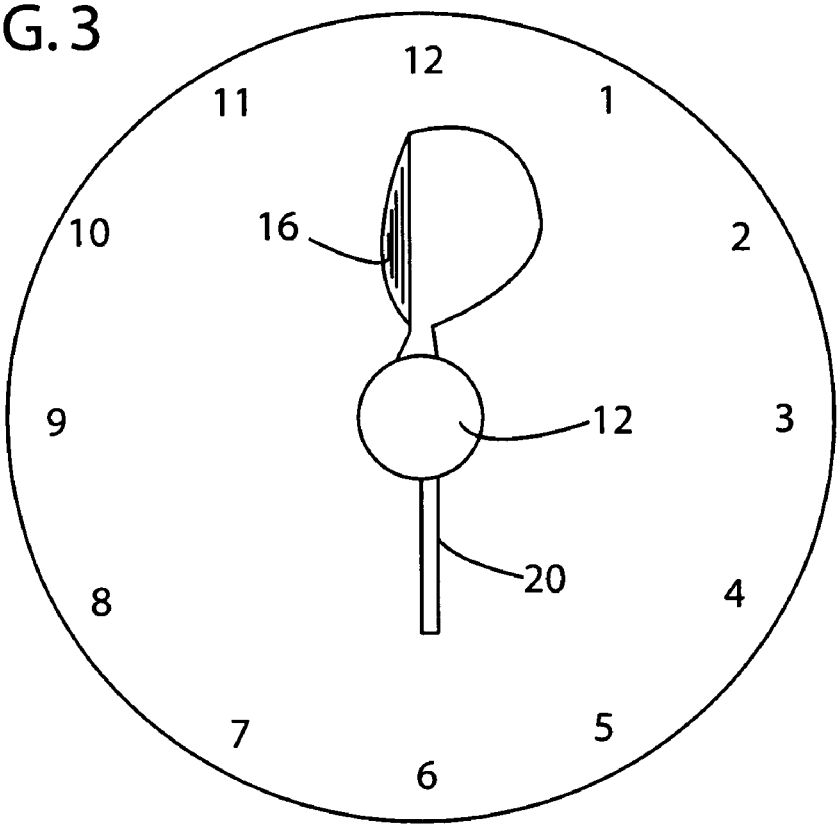
FIG. 3 is a schematic view of the golf club swing training device of FIG. 1 shown from an end of the shaft, shown in a "6 O'clock" position.

The wing 20 is free to pivot with respect to the brackets 18 (and with respect to the golf club shaft that the brackets are attached to) over a travel range. Preferably the travel range is restricted to 60 to 120 degrees, and most preferably about 80 to 100 degrees. In the preferred embodiment shown in the drawings, the travel range is about 90 degrees. FIGS. 2 and 3 show two extremes of the travel range. In FIG. 2, the wing 20 is at right angles to the club head or face, as viewed from above, and can be considered a "3 O'Clock" position. In FIG. 3, the wing 20 is on the side of the shaft opposite the club head 16, and is generally parallel to the club head or face. This can be considered a "6 O'Clock" position. Preferably the travel range is defined as the pivotal movement of the wing between 3 O'Clock and 6 O'Clock.

Figure 4:
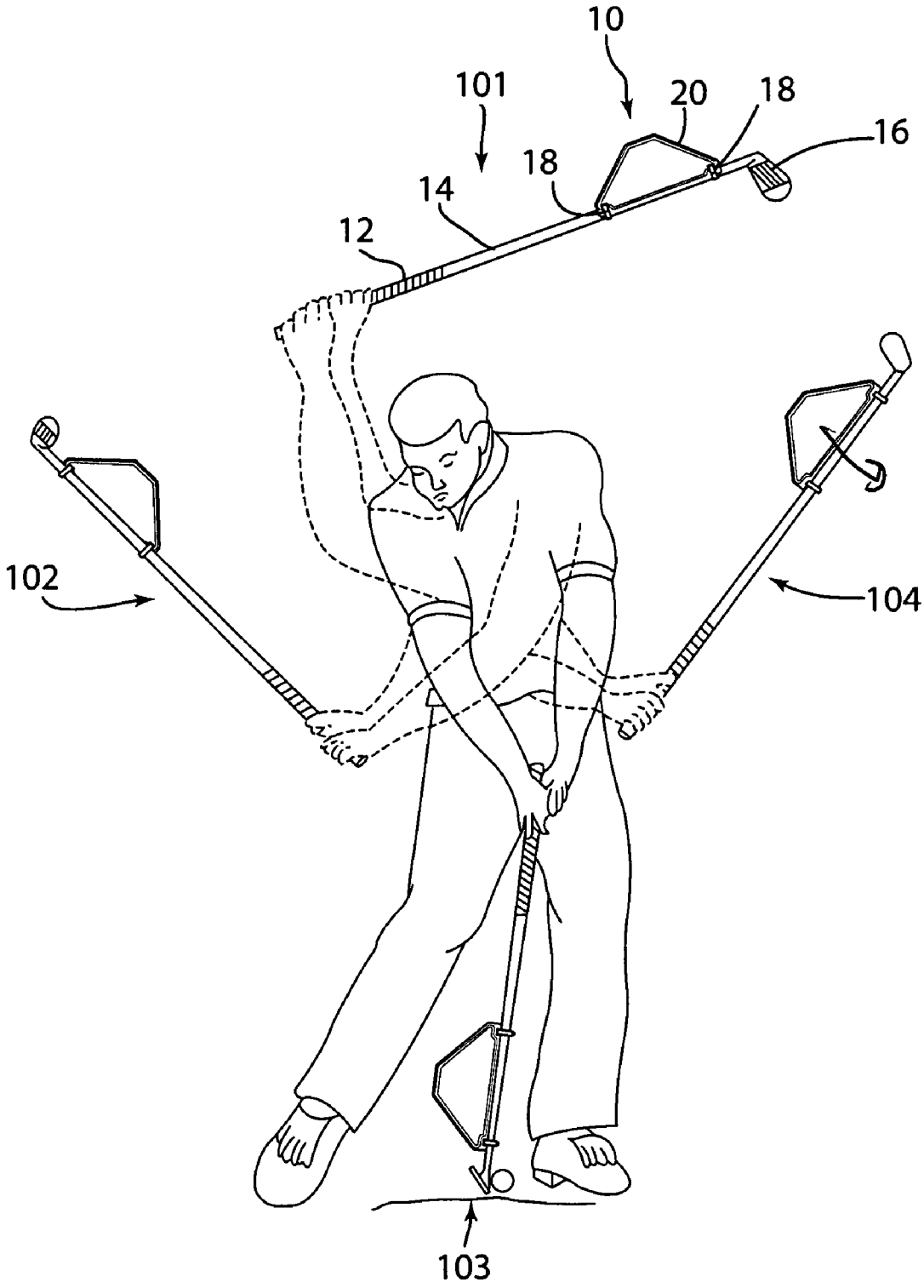
FIG. 4 is a perspective view of the golf club swing training device of FIG. 1, shown gripped by a golfer in various positions along a golf swing.

FIG. 4 shows a right handed player holding a golf club 12 with a golf club swing training device 10 in a series of positions. At initial address of the ball (not shown, but where the club head is adjacent the ball prior to initiation of the backswing) gravity places the wing 20 near the 6 O'Clock position. The player's backswing moves the club to position 101, near the top of the backswing. The wing is near the 6 O'Clock position. As the downswing begins the wing 20 moves from the 6 O'Clock position to the 3 O'Clock position. After the initial movement commenced at the start of the downswing, the wing does not move a great deal with respect to the golf club, as is shown at partial downswing position 102. At impact with a golf ball position 103, the wing is at the 3 O'Clock position. At the follow-through swing, position 104, the wing is shown returning to the 6 O'Clock position.

Figure 5:
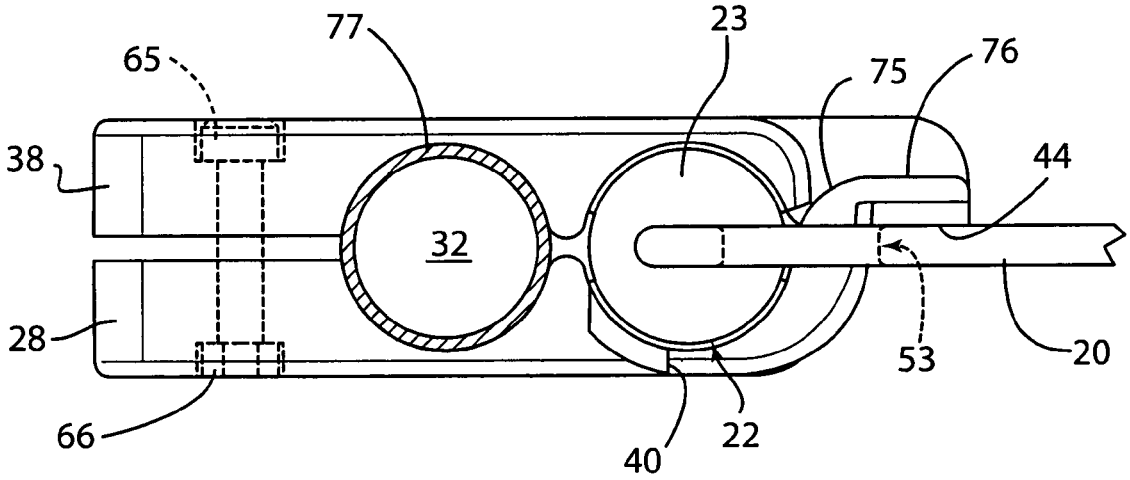
FIG. 5 is a cross section view of the bracket and wing taken along line 5-5 in FIG. 2, with the golf club removed, showing the wing at the 3 O'clock position.
Figure 6:
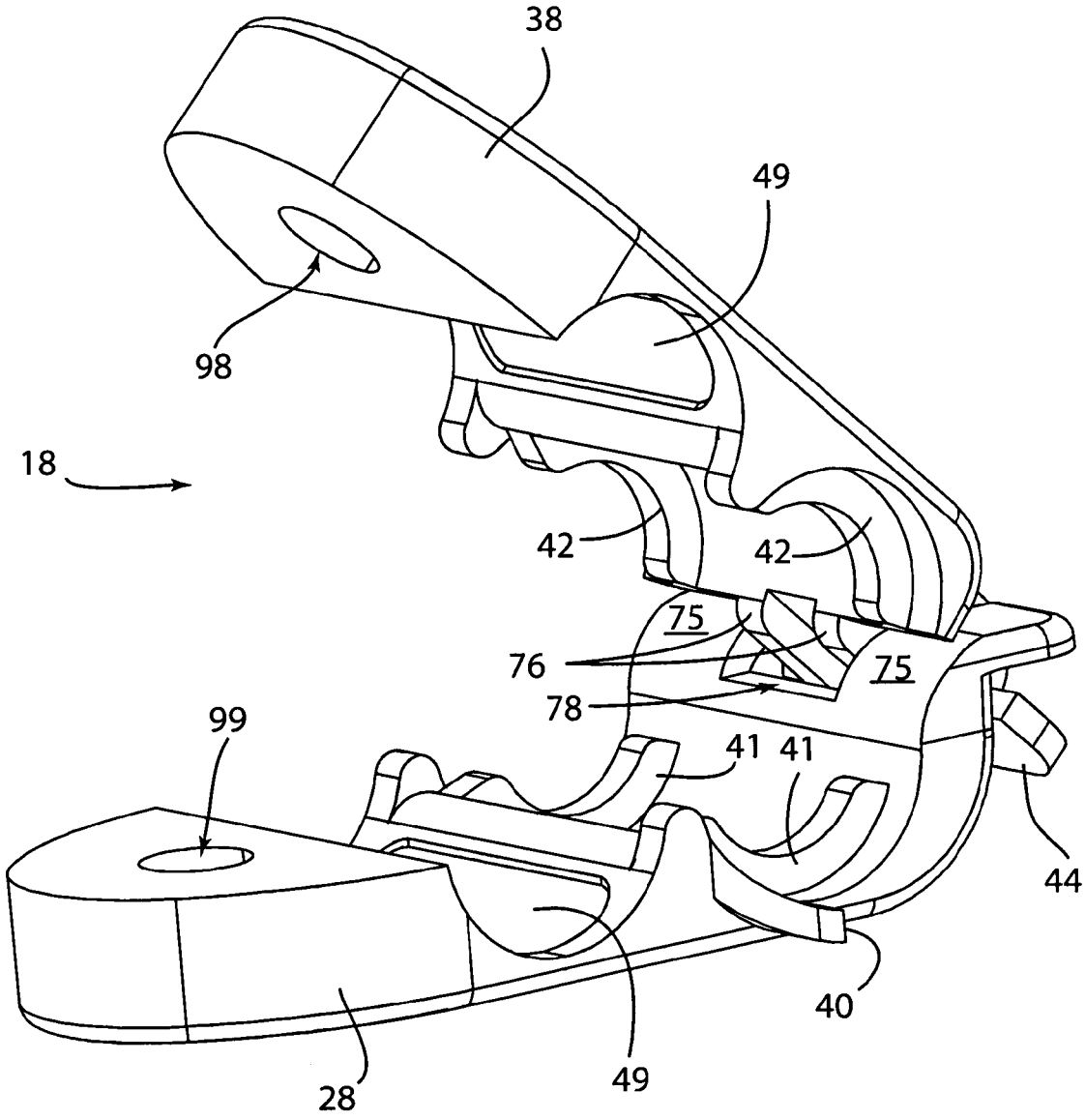
FIG. 6 is an isometric view of the bracket with bracket halves opened.

FIG. 5 is a cross section view of one of the brackets 18 showing the wing 20 in the 3 O'Clock position. Bracket 18 is preferably formed from a pair of bracket halves 28, 38 formed of an injection molded material, such as a thermoplastic or a thermoset plastic. The wing 20 has an opening 53 (shown in phantom) which receives one end of the bracket halves. Advantageously no fastener is required at this end. Instead, as best seen in the perspective view of FIG. 6, a pair of flanges 75 on the first bracket half 28 are separated by a gap 78, and a T-shaped flange 76 on the second bracket half 38 fits into the gap 78. During assembly, the flanges 75 are inserted into the opening 53 and the flange 76 inserted into gap 78. The two bracket halves 28, 38 are closed together and are provided with corresponding openings 99, 98 which are adapted to receive a fastener, such as a screw 65 and nut 66. When closed together, the bracket halves cooperate to define a pocket 22 which receives a pivot shaft 23 of the wing, and a recess 32 which snugly receives the shaft 14 of the golf club. Optionally an insert 77 may be provided to help ensure a tight fit between the bracket and the golf club so that the two, when assembled, move together. Subsurfaces 49 may provide a cavity for mounting the insert. Each bracket half may optionally be provided with ribs 41, 42 which engage the pivot shaft 23 of the wing when the bracket is closed. This design of the bracket halves greatly simplifies assembly and disassembly.

Once assembled, the wing 20 can pivot with respect to the bracket 18 over a travel range. First surfaces 40 will abut against the wing when the wing moves to the 6 O'Clock position. As shown in FIG. 5, second surface 44 abuts against the wing (on the side of the wing opposite the side the first wing abuts against at the 6 O'Clock position) at the 3 O'Clock position. Thus, in the preferred embodiments shown in the drawings, these surfaces cooperate to advantageously restrict the travel range to about go degrees.

Figure 7:
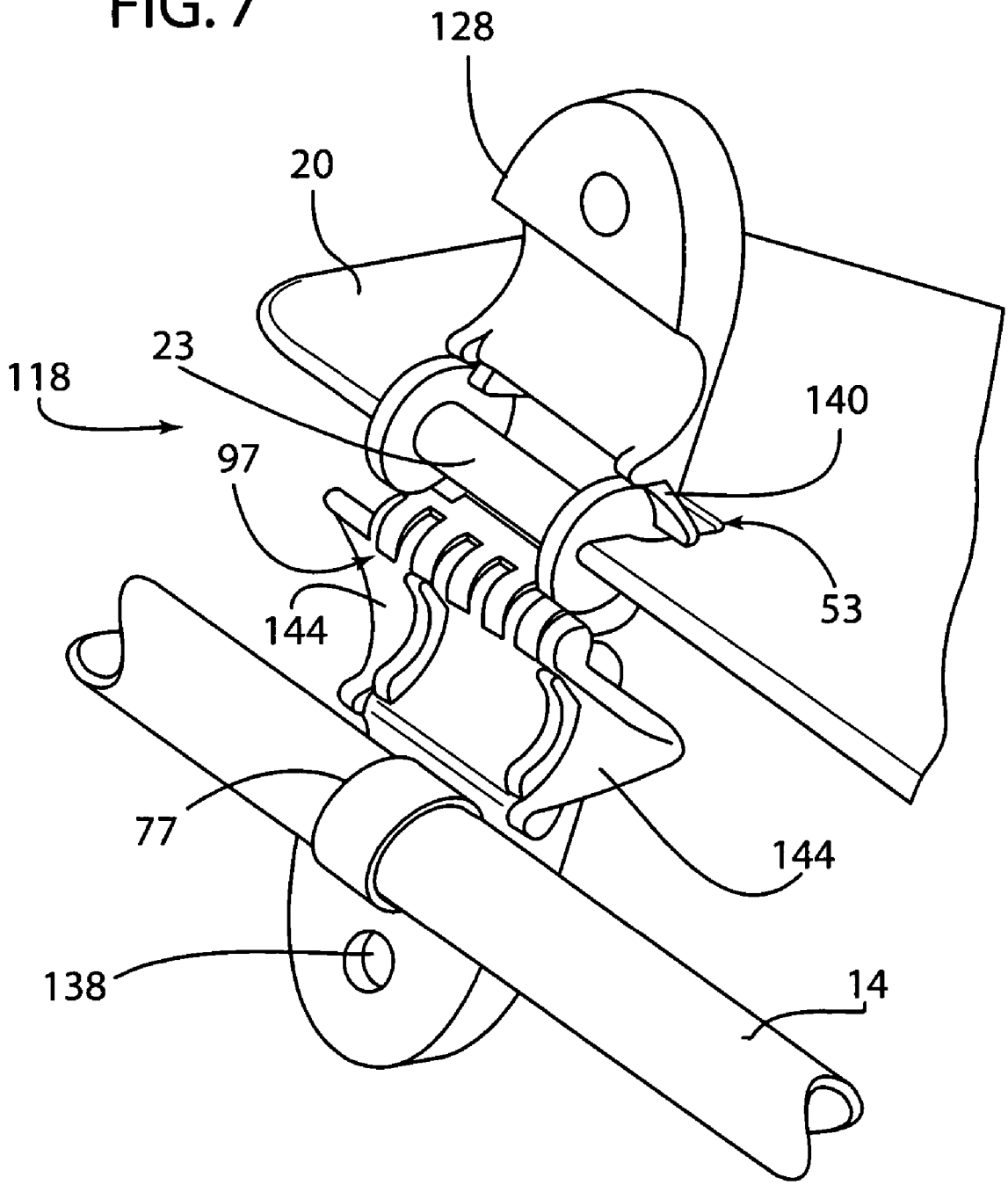
FIG. 7 is an isometric view of an alternative preferred embodiment of the bracket, shown with bracket halves opened.

FIG. 7 is an isometric view of an alternative preferred embodiment for a bracket 118, shown with the bracket halves 128, 138 opened. Bracket 118 is similar to bracket 18 in defining a recess, a pocket, and being provided with openings to receive a fastener. The connection between the first bracket 128 and second bracket 138 may be provided with an interlocking hinge assembly 97 with one half bracket or the other provided with arcuate flanges and the other provided with a series of arcuate grooves which receive the flanges. Also, the geometry of both the first surface 140 and the second surface 144 has been modified somewhat. These surfaces are still used to define the ends of the travel range of the wing 20 with respect to the bracket 118.

The backswing and follow through are important parts of the golf swing. Allowing the wing to float over the travel range is important in that it provides (a) the inertial resistance and therefore the torque at the beginning of the backswing; (b) wind resistance and thus appropriate torque during the backswing, (c) the inertial resistance and appropriate torque in transition at the top of the swing; (d) the wind resistance and torque during the downswing; and (e) does not hinder the natural rotation of the club during the follow through. Other known golf club swing training devices typically only help with inertial resistance in transition at the top of the swing and torque during the downswing.

In operation, the golf club swing training device functions in the following manner. At address, the wing is in the 6 o'clock position. As the back swing begins, the wing is still in the 6 o'clock position, and the wing 20 is oriented so that the generally planar wing is aligned with the motion of the rest of the desired backswing. This reduces the wind resistance and allows and encourages the player to continue the backswing in the desired plane. At the top of the swing, the transition from the backswing to the downswing causes an immediate change in the position of the wing to the 3 o'clock position. Inertia puts a torque on the golf club which urges the player to begin to close the clubface. During the downswing, the wing is in a plane perpendicular to the desired plane of the downswing, and wind resistance on the wing increases torque on the golf club. This encourages the (right-handed) player to pronate the right wrist and supinate the left wrist and thereby close the clubface, encouraging the club head to be square (i.e., when the club face is perpendicular to the intended target line) with the golf ball at impact. This effect increases as the club head speed increases. As the player follows through, the wing remains in its most aerodynamic position. The players swing continues to be guided along the desired path. Gradually the wing returns to the 6 o'clock position as the swing is completed. The device is useful for reducing slicing, and more generally helps improve wrist pronation timing.

From the foregoing disclosure and detailed description of certain preferred embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A golf club swing training device adapted for use with a golf club having a shaft and a head, comprising, in combination:

a single wing adapted to provide resistance to motion as the club is swung; and a bracket connecting the golf club with the wing, wherein the bracket defines a pocket which receives the shaft of the golf club, and a length of the shaft of the golf club at the bracket defines a first axis;

wherein the wing is pivotably attached to the bracket, and freely pivots about an axis generally parallel to and offset from the first axis over a travel range restricted to 60-120 degrees with respect to the bracket.

2. The golf club swing training device of claim 1 wherein the wing is substantially planar.

3. The golf club swing training device of claim 1 wherein the wing defines an opening which receives the bracket.

4. The golf club swing training device of claim 1 wherein the bracket comprises a first half and a second half which cooperate to define a recess adapted to receive the shaft of the golf club, and the first axis is generally parallel to the shaft.

5. The golf club swing training device of claim 1 wherein both the bracket and the wing are formed of an injection molded material.

6. The golf club swing training device of claim 1 wherein the travel range is about 80 to 100 degrees with respect to the bracket.

7. The golf club swing training device of claim 1 further comprising an insert positoned between the bracket and the shaft.

8. A golf club swing training device adapted for use with a golf club having a shaft and a head, comprising, in combination:

a wing adapted to provide resistance to motion as the club is swung; and a bracket adapted to connect the golf club with the wing, wherein the bracket comprises a first half and a second half which cooperate to define a recess adapted to receive the shaft of the golf club, and to define a pocket which receives a pivot shaft of the wing;

wherein the bracket halves pivot about the pivot shaft, and the wing is pivotably attached to the bracket and is restricted to a travel range of 60-120 degrees with respect to the bracket.

9. The golf club swing training device of claim 8 further comprising a screw and a nut which cooperate to secure the bracket halves together.

10. The golf club swing training device of claim 8 wherein the first half bracket has a first surface which abuts against the wing at a first end of the travel range of the wing, and The second halt bracket has a second surface which abuts against the wing at a second end of the travel range of the wing.

* * * * *